US006647611B2

(12) United States Patent
Zhang

(10) Patent No.: US 6,647,611 B2
(45) Date of Patent: Nov. 18, 2003

(54) HOLDING APPARATUS AND METHOD UTILIZING MAGNETORHEOLOGICAL MATERIAL

(76) Inventor: Xuesong Zhang, 2408 Albert Rasche Dr., Cape Girardeau, MO (US) 63701

( * ) Notice: Subject to any disclaimer, the term of this patent is extended or adjusted under 35 U.S.C. 154(b) by 0 days.

(21) Appl. No.: 09/901,841

(22) Filed: Jul. 10, 2001

(65) Prior Publication Data

US 2001/0050454 A1 Dec. 13, 2001

Related U.S. Application Data

(63) Continuation-in-part of application No. 09/506,890, filed on Feb. 18, 2000, now Pat. No. 6,267,364.

(51) Int. Cl.[7] ..... B25B 11/00
(52) U.S. Cl. ..... 29/559; 269/7
(58) Field of Search ..... 269/7, 8, 266; 252/62.52, 62.54, 62.55, 62.56; 29/559

(56) References Cited

U.S. PATENT DOCUMENTS

| | | | | | |
|---|---|---|---|---|---|
| 2,667,237 | A | | 1/1954 | Rabinow | |
| 3,197,682 | A | * | 7/1965 | Klass et al. | 269/289 R |
| 3,660,949 | A | * | 5/1972 | Coes, Jr. | 164/76.1 |
| 3,818,646 | A | * | 6/1974 | Peterson | 269/106 |
| 3,953,013 | A | * | 4/1976 | Griffith et al. | 269/21 |
| 3,978,398 | A | | 8/1976 | Molina | |
| 4,025,448 | A | | 5/1977 | Sudol | |
| 4,033,569 | A | * | 7/1977 | Dunn | 269/106 |
| 5,143,637 | A | | 9/1992 | Yokouchi et al. | |
| 5,509,888 | A | * | 4/1996 | Miller | 600/29 |
| 5,549,837 | A | * | 8/1996 | Ginder et al. | 252/62.52 |
| 5,645,752 | A | | 7/1997 | Weiss et al. | |
| 5,667,715 | A | * | 9/1997 | Foister | 252/62.52 |
| 5,827,444 | A | | 10/1998 | Shimizu et al. | |
| 5,902,513 | A | | 5/1999 | Shimizu et al. | |
| 5,906,767 | A | | 5/1999 | Karol et al. | |
| 5,947,662 | A | * | 9/1999 | Becker et al. | 269/7 |
| 5,985,168 | A | | 11/1999 | Phule | |

* cited by examiner

*Primary Examiner*—Robert C. Watson
(74) *Attorney, Agent, or Firm*—Polster, Lieder, Woodruff & Lucchesi, L.C.

(57) ABSTRACT

A fixturing or workpiece holding and clamping apparatus or device, as well as method, utilizing the viscosity increase or solidification of a magnetorheological liquid or rigidity increase of a malleable semi-solid or clayish magnetorheological material to secure both regular and irregular shaped workpieces for precision machining or measuring operations. The workpiece is placed in a desired position and orientation in an open cell containing a magnetorheological liquid or medium which conforms to a portion of the surface of the workpiece. A magnet then applies a magnetic field to the magnetorheological liquid or material to increase the viscosity or rigidity thereof, applying a uniform clamping pressure to secure the workpiece in the desired position and orientation for machining or measuring operations. A clamp configured to apply a compressive force to the viscous or rigid magnetorheological medium optionally increases the uniform clamping pressure applied to the workpiece by compressing the magnetorheological material to further increase viscosity and rigidity thereof. The solidified magnetorheological material reverts to a liquid, semi-solid, or clayish state for removal of the fixture and workpiece upon release of the compressive force and removal of the magnetic field.

7 Claims, 10 Drawing Sheets

HOLDING APPARATUS AND METHOD UTILIZING MAGNETORHEOLOGICAL MATERIAL

CROSS-REFERENCE TO RELATED APPLICATIONS

This is a Continuation-in-Part application of U.S. application Ser. No. 09/506,890 filed on Feb. 18, 2000, from which priority is claimed, now U.S. Pat. No. 6,267,364 B1.

STATEMENT REGARDING FEDERALLY SPONSORED RESEARCH

Not Applicable.

BACKGROUND OF THE INVENTION

The present invention relates generally to a fixturing or workpiece holding and clamping device and method, and in particular, to a fixturing or workpiece holding and clamping device utilizing a viscosity increase or solidification of a magnetorheological colloidal liquid or clay, as a method to secure both regular and irregular shaped workpieces for precision machining or measuring operations.

The securing of irregularly shaped delicate and brittle workpieces, such as ceramics components, glass components, and jet engine or turbine blades, for machining operations without resulting in damage to the workpiece has been found to be difficult. Typical methods of clamping through clamps or fixtures are not practical since they can cause permanent damage to the workpiece. As a result, the traditional solution to prevent damage to these workpieces includes encapsulation of a portion of the workpiece by the casting of a low melting point molten matrix material such as lead or zinc around the a portion of the workpiece, such as the airfoil section, after which the machining or measuring of the remaining portion is performed, as is seen in U.S. Pat. No. 5,947,662 to Becker et al. for "System For Holding Thin-walled Workpiece During Machining."

Generally, this procedure involves inserting a first portion of the workpiece into a cast iron block having a cavity which is significantly larger than the workpiece itself. The molten matrix material is then poured into the cavity, surrounding and encapsulating the workpiece. After the matrix material cools and solidifies, the workpiece is secured in a fixed position for the machining or measuring operations. Upon completion of the machining or measuring operation, the matrix material is melted away from the encapsulated portion of the workpiece, leaving a finished product. This procedure, however, adds considerably to the expense of producing such workpieces, increases health and environmental risks associated with the vapors released from the molten matrix material, and fails to adequately protect the workpiece against deformation damage during the machining operations. Furthermore, such solutions cannot be applied to workpieces which are vulnerable to damage from the heating and cooling cycles associated with the addition and removal of the matrix material, or which have finished or treated surfaces which may become contaminated by residue from the molten matrix material.

Other solutions to the problem of securing irregularly shaped workpieces include the use of complex single-purpose hydraulic clamping devices such as is shown in U.S. Pat. No. 4,033,569 to Dunn for "Deformation-Preventing Workpiece-Holding Fixture for Machine Tools." These devices are typically suitable for holding only a limited range of irregularly shaped objects, and operate by applying a plurality of clamping members to a number of locations on the surface of the workpiece. Application of a clamping force to only a limited number of locations along the surface of a workpiece while retaining it during the machining operations can result in the buildup of stress or damage in the workpiece from the non-uniform application of the clamping forces.

A similar solution is exemplified by U.S. Pat. No. 3,818,646 to Peterson for "Fixture For Holding Precisely Shaped Parts" wherein an irregularly shaped workpieces, such as the thin elongated airfoil portion of a jet engine turbine blade, is secured for machining operations by a plurality of individual movable pins extending from the side wall of a clamping fixture to engage both the convex and concave surfaces of the workpiece. While increasing the number of individual movable pins extending from the side wall of the clamping fixture results in a more uniform application of clamping force to the irregularly shaped workpiece, this solution still fails to provide a completely uniform application of clamping force, and is limited to operation on workpieces having exterior surfaces with generally smooth curvature.

An alternative solution which applies a more uniform clamping pressure to the surfaces of a regular or irregular workpiece involves the use of a dry particulate material fluidized by the pressure of a gas for insertion of a workpiece, which is then substantially solidified by the application of a vacuum force or magnetic field to the dry particulate material. Examples of these types of fixturing devices may be found in U.S. Pat. No. 3,953,013 to Griffith et al. for "Method and Apparatus for Clamping A Workpiece In A Quasi-Liquid Medium" and U.S. Pat. No. 3,660,949 to Cose, Jr., for "Work Holder For Irregular Shaped Workpieces." However, the use of a dry, particulate fluidizable material or quasi-liquid requires a complicated variety of associated gas injection and vacuum generating elements, as well as containment for the dry particulate fluidizable material, since an excess of fluidizing pressure can easily expel the dry, particulate material from the device.

A second alternative solution for applying a more uniform clamping pressure to the surfaces of a regular or irregular workpiece involves the use of electrofluids which respond to the presence of either alternating electric fields or a voltage difference by manifesting an apparent change in bulk viscosity. It is known that if these fluids are applied as a film over a dielectric surface, and an alternating electric field is applied to the fluid from beneath the surface, a workpiece placed on or in the electrofluid film causes the electrofluid to be energized by the electric field to secure the workpiece firmly in place. These devices, exemplified by U.S. Pat. No. 3,197,682 to Klass et al. require the application of a high voltage and potentially dangerous, three-phase current to the device, and do not permit workpieces to be immersed in the electrofluid film to any great depth, thereby limiting the clamping pressure of the device. Furthermore, electrorheological fluids are temperature sensitive, and typically have an inability to withstand water contamination, rendering them useless in machining applications wherein a machining tool is cooled by the application of water or other water-based liquid coolant to an exposed cutting surface.

Accordingly, there is a need in the industry for a self-contained fixturing or workpiece holding and clamping apparatus or device and method capable of securing both regular and irregularly shaped workpieces, such as ceramic components, glass components, and turbine blades, for machining operations with a uniform clamping force so as to reduce the stresses associated with the machining operations on the workpiece, while also being easy to use, simple to construct, and which also eliminates the risk of environmental and workpiece contamination, as well as the risk to an operator's health from electric shock or the inhalation of harmful vapors or particles.

It is believed that an apparatus and method for immobilizing and securing both regular and irregularly shaped workpieces through the solidification or viscosity increase of a colloidal liquid, elastomer, semi-solid, or clayish magnetorheological material subjected to a magnetic field will solve many of the problems associated with traditional work holding fixtures. It is known that in the presence of an appropriate magnetic field, solid magnetizable particles in colloidal liquids, semi-solids, elastomers, or clayish materials such as jells, greases, waxes, rubbers, putty, or clay move into alignment, forming fibrous structures parallel to the applied field, significantly increasing the viscosity of the fluids and substantially decreasing the ability of the material to flow or be sheared.

A magnetizable carrier liquid or ferrofluid may be substituted for the liquid used as a carrier for the solid magnetizable particles in traditional magnetorheological liquids. While ferrofluids themselves do not solidify when subjected to an applied magnetic field, they similarly exhibit magnetic field-induced viscosity increases, and may be utilized to achieve yield stress levels significantly in excess of traditional magnetorheological liquids, as is taught by U.S. Pat. No. 5,549,837 to Ginder et al. for "Magnetic Fluid-Based Magnetorheological Fluids."

The basis for the magnetorheological effect can be explained by the inter-particle forces induced by the applied magnetic field. When an external magnetic field is applied to an initially random arrangement of magnetizable particles, a magnetic moment which is approximately parallel to the applied field is induced in each particle. The force between two particles whose moments are aligned head-to-tail is attractive, promoting the formation of chains or more complicated networks of nearly contacting particles aligned along the direction of the field, significantly increasing the viscosity and essentially solidifying the material. The strength of this solidified magnetorheological material can be characterized by the yield sheer stress at which the network of aligned particles is disrupted and the particles flow. Materials having a high yield stress can sustain larger mechanical forces when solidified in the presence of a magnetic field before flowing. Magnetorheological liquids easily obtain yield stress values in excess of 5 psi in the presence of a magnetic field, and may be prepared to achieve yield stresses on the order of 20 psi as taught by U.S. Pat. No. 5,667,715 to Foister for "Magnetorheological Fluids." In general, for a magnetorheological liquid, it is known that an increase in the flux density of the magnetic field to which it is subjected will result in an increase in the yield stress, i.e. an increase in viscosity which in this context is understood to mean solidification.

BRIEF SUMMARY OF THE INVENTION

Among the several objects and advantages of the present invention are:

- The provision of a work holding apparatus or device utilizing an increase in viscosity or solidification of a magnetorheological material to secure a workpiece;
- The provision of the aforementioned work holding apparatus or device wherein the magnetorheological material has a high viscosity in the absence of a magnetic field;
- The provision of the aforementioned work holding apparatus or device wherein the magnetorheological material is a semi-solid or clayish material;
- The provision of the aforementioned work holding apparatus or device wherein the magnetorheological material is a liquid material;
- The provision of the aforementioned work holding apparatus or device wherein the viscosity increase or solidification of the magnetorheological material is achieved by the application of a magnetic field to the magnetorheological material;
- The provision of the aforementioned work holding apparatus or device wherein the workpiece is further secured by the application of a clamping force to the solidified magnetorheological material, further increasing the viscosity of the magnetorheological material;
- The provision of the aforementioned work holding apparatus or device wherein a decrease in viscosity of the magnetorheological material is achieved by the removal of the magnetic field;
- The provision of the aforementioned work holding apparatus or device wherein the workpiece may have either a regular or irregular shape;
- The provision of the aforementioned work holding apparatus or device wherein the magnetorheological material is contained within an open-faced container;
- The provision of the aforementioned work holding apparatus or device wherein the open-faced container is configured to absorb peak vibrational forces, preventing movement or climbing of the workpiece inside the work holding device;
- The provision of the aforementioned work holding apparatus or device wherein the workpiece is secured for measuring or machining operations by the solidification of the magnetorheological material;
- The provision of the aforementioned work holding apparatus or device wherein the magnetorheological material attenuates vibrations induced in the workpiece by the machining operations;
- The provision of the aforementioned work holding apparatus or device wherein the magnetorheological material applies a uniform clamping force to the workpiece upon solidification;
- The provision of the aforementioned work holding apparatus or device wherein the apparatus or device is suited for use in securing heat sensitive and non-magnetic materials;
- The provision of the aforementioned work holding apparatus or device wherein the apparatus or device is suited for use in securing both metallic and non-metallic workpieces;
- The provision of the aforementioned work holding apparatus or device wherein the workpiece is not subjected to a heating and cooling cycle;
- The provision of the aforementioned work holding apparatus or device wherein the emission of harmful and environmentally damaging vapors or particulate matter is significantly reduced or eliminated;
- The provision of the aforementioned work holding apparatus or device wherein the apparatus or device requires no external power source;
- The provision of the aforementioned work holding apparatus or device wherein the apparatus or device requires no associated fluid pressure or vacuum delivery systems;
- The provision of the aforementioned work holding apparatus or device wherein the apparatus or device is readily adaptable to operate as a component in an assembly line manufacturing process; and The provision of the aforementioned work holding apparatus or device wherein the device is easy to assemble, simple to operate, and may be manufactured for a low cost.

Briefly stated, the preferred embodiment of the work holding apparatus or device of the present invention utilizes a magnetorheological material and a work holding container or fixture to secure a workpiece of either a regular or irregular shape for machining or measuring operations without damage to the workpiece. The workpiece is secured within the container, and the container or holding fixture is then positioned within a open cell containing either a liquid, semi-solid, or clayish magnetorheological material which flows or is molded around a portion of the workpiece placed within the container to conform to the surfaces of the workpiece and the open cell. The cell is located in an adjustable gap of a magnet such that a magnetic field generated by either a permanent magnet or an electromagnet will pass through the cell.

Once the workpiece is secured within the container, and partially surrounded by the magnetorheological material in the cell, a magnetic field is applied to the magnetorheological material, solidifying it to apply a uniform clamping pressure to the surfaces of the workpiece encapsulated therein. The clamping pressure may be further increased by decreasing the gap of the magnet within which the cell is placed, compressing the compressible sealing material and squeezing the solidified magnetorheological material within the cell. Under compression, the magnetic particles comprising the magnetorheological material form thick columnar structures, further increasing the viscosity or solidifying of the magnetorheological material. The solidified magnetorheological material supplies a uniform holding force to the workpiece, and allows the container or holding fixture within which the workpiece is placed to absorb any peak forces applied to the workpiece, preventing displacement thereof during a machining or measuring operation. The solidified magnetorheological material further serves to attenuate any vibrations generated in the workpiece during the machining or measuring operations. Upon completion of the machining or measuring operation, the clamping pressure is withdrawn from the cell, and the magnetic field removed, thereby allowing the magnetorheological material to revert to a less viscous state, after which the workpiece may be removed from the container or holding fixture and the device reset for a subsequent use.

In addition, the present invention also relates generally to a method for immobilizing or securing a workpiece having either a regular or irregular shape wherein a portion of the workpiece is immersed in a liquid magnetorheological material at a desired position and orientation or placed between deformable portions of a semi-solid, colloidal, elastomeric, or clayish magnetorheological material. A magnetic field is applied to the magnetorheological material to cause the viscosity of the material to substantially increase, resulting in the solidification of the magnetorheological material about the workpiece. The increase in viscosity results in the application of a uniform holding force to the surface of the workpiece. A clamping pressure applied to the solidified magnetorheological material results in an additional increase in the viscosity of the magnetorheological material, thereby increasing the uniform holding force on the surface of the workpiece, immobilizing or securing the workpiece in place. Once immobilized or secured, the workpiece is machined or measured as desired. To remove the finished workpiece, the process is reversed. First, any clamping force applied to the solidified magnetorheological material is removed. Next, the magnetic field is removed, resulting in a decrease in the viscosity of the magnetorheological material and a reversion to a rest state. Finally, the finished workpiece is removed from the magnetorheological material or from between the deformable portions.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Figure 3:
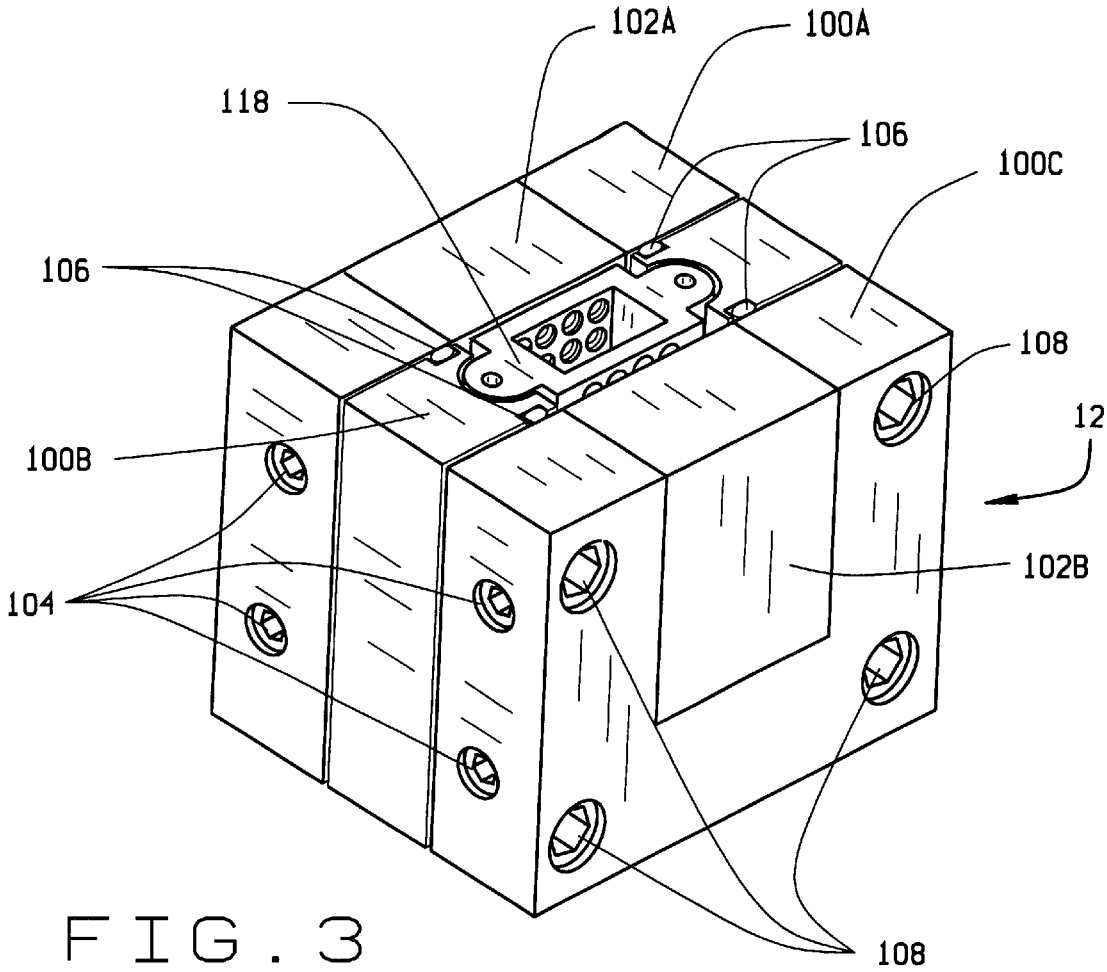
FIG. 3 is a perspective view of a magnetorheological liquid containing cell.
Figure 5:
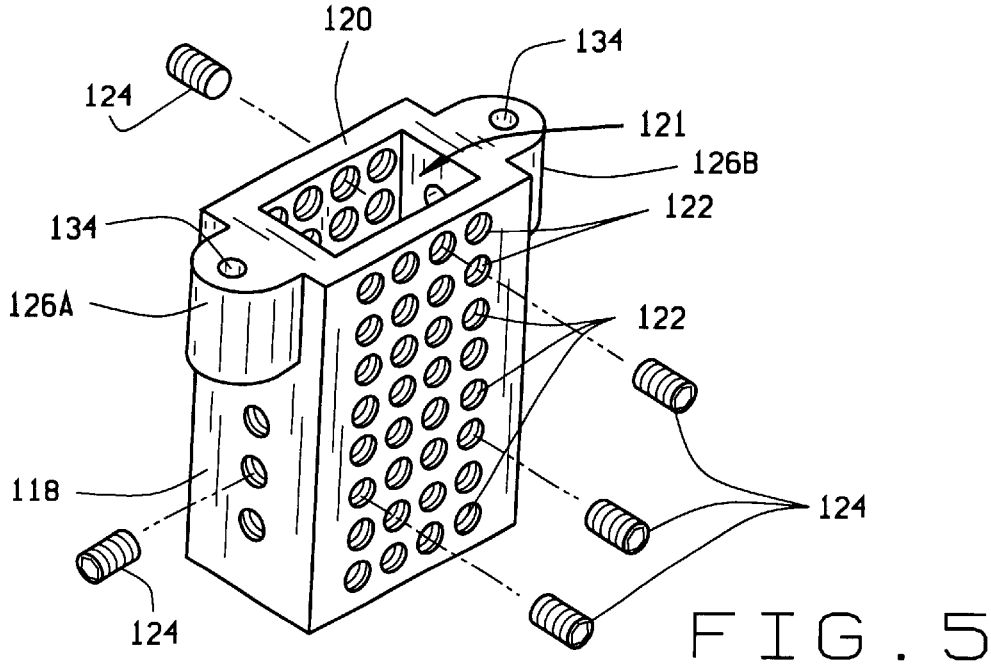
FIG. 5 is a perspective view of one embodiment of the workpiece holding fixture seen in FIG. 4.
Figure 4:
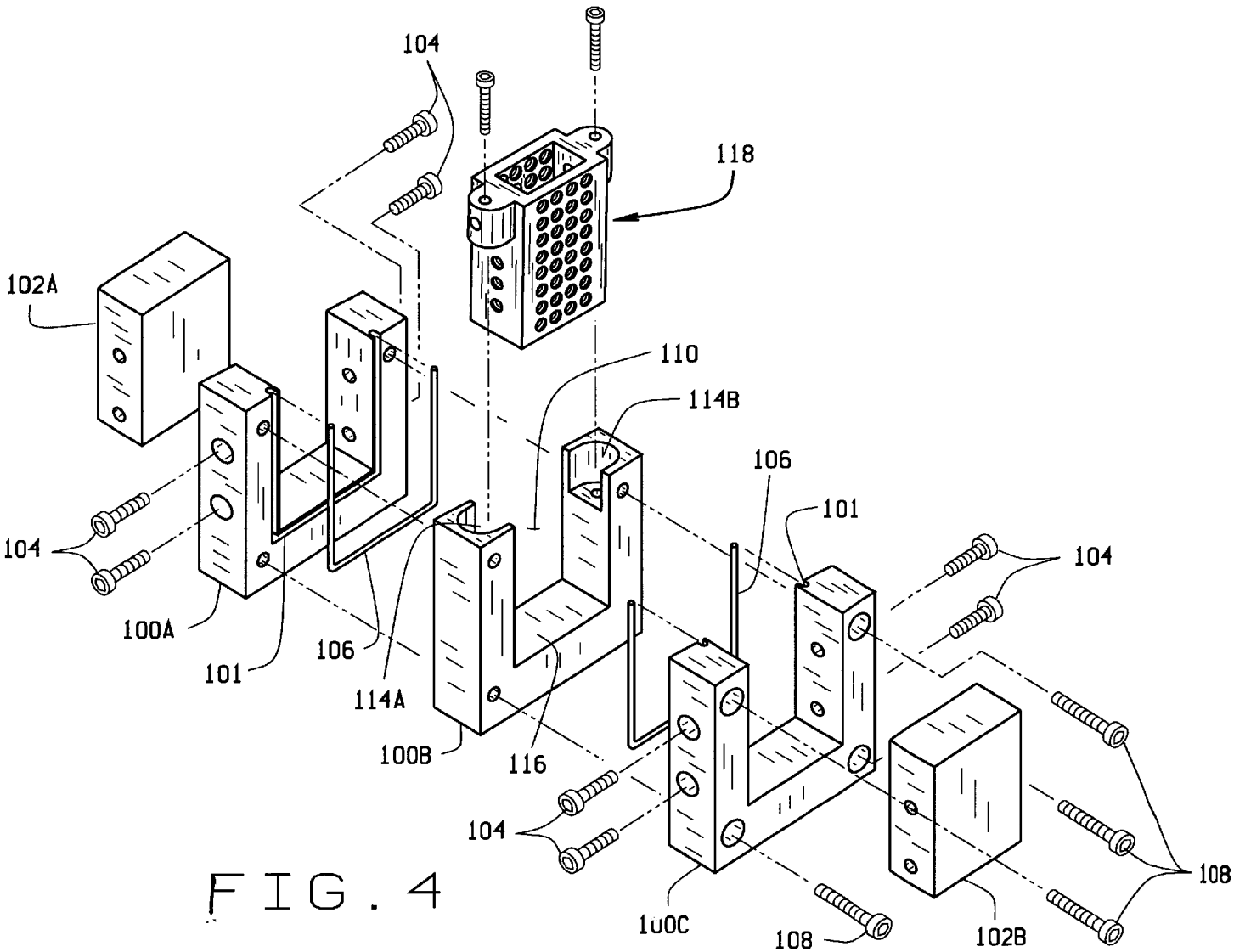
FIG. 4 is an exploded view of the magnetorheological liquid containing cell illustrating placement of a workpiece holding fixture.
Figure 6A:
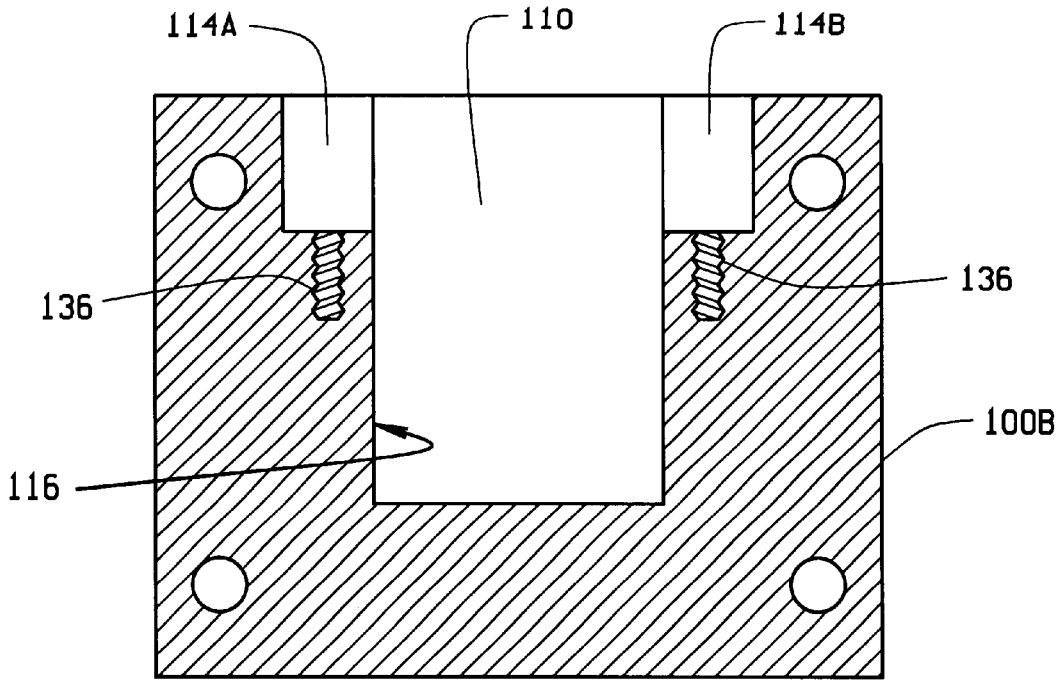
Figure 6B:
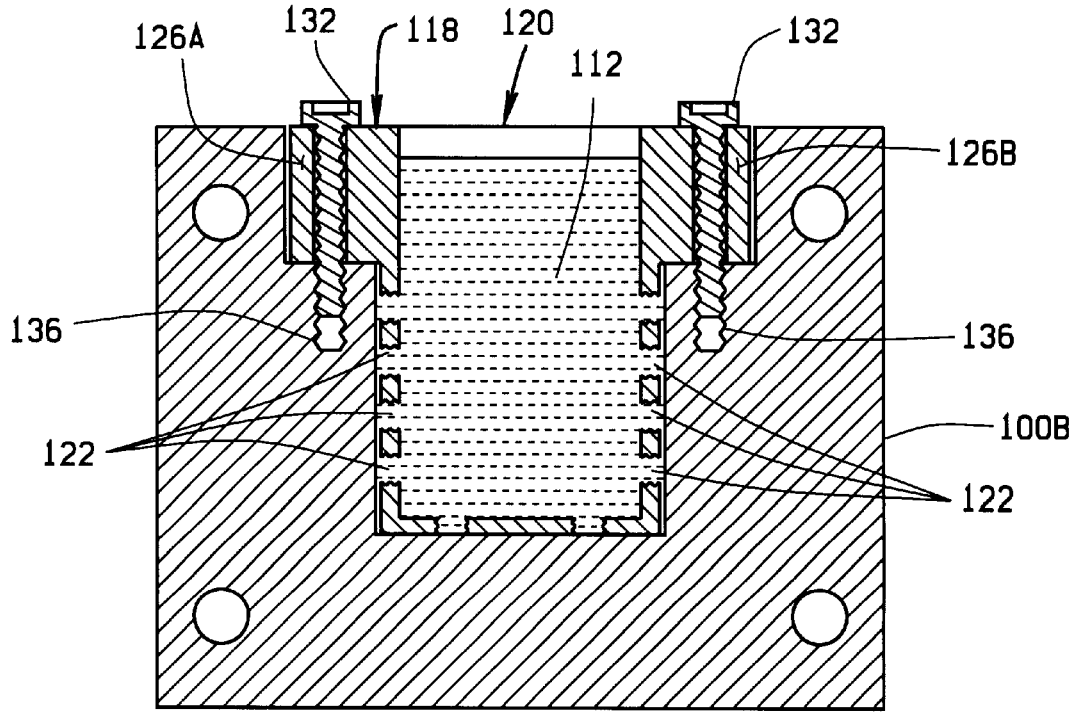
Figure 6C:
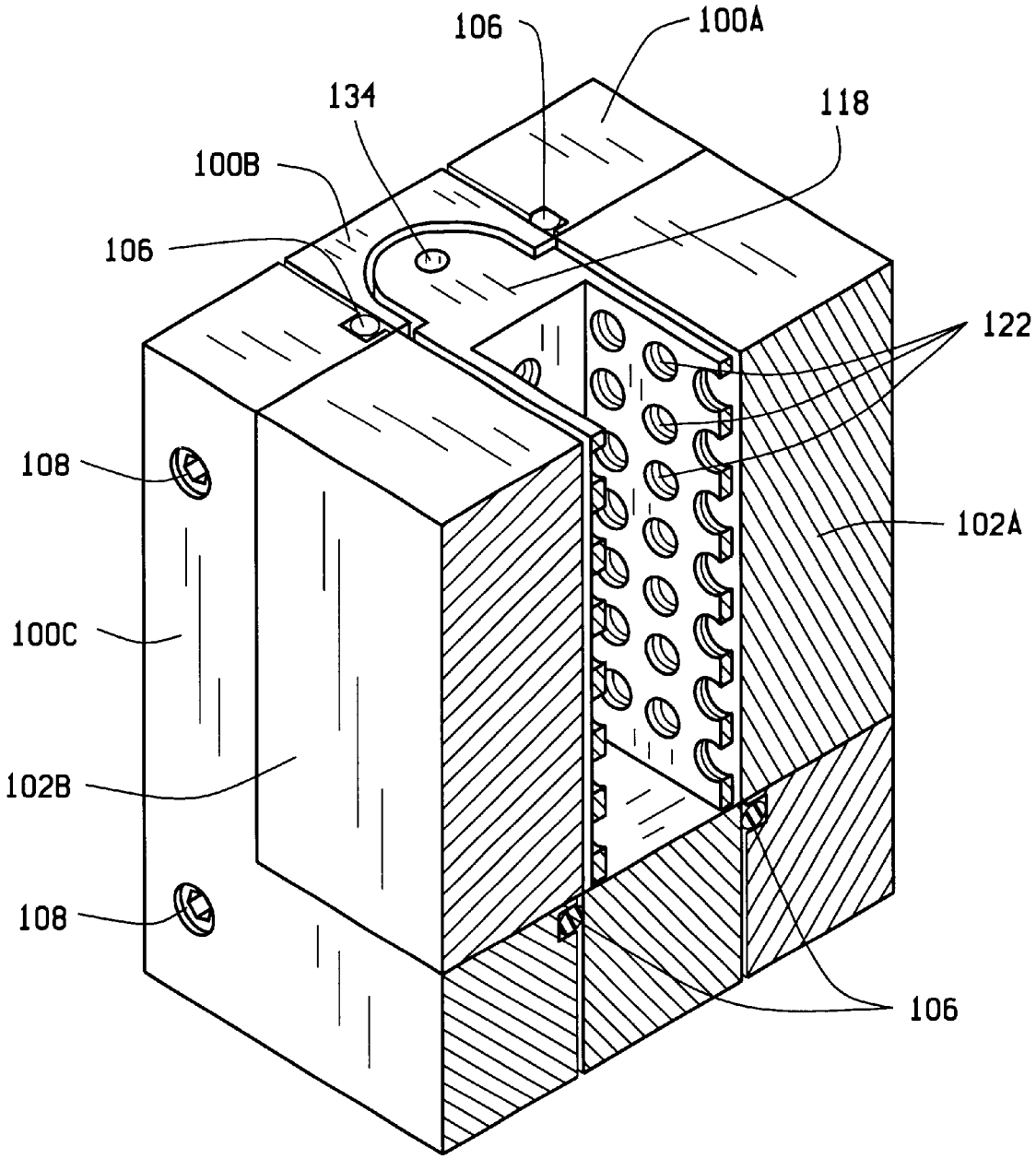
Figure 7:
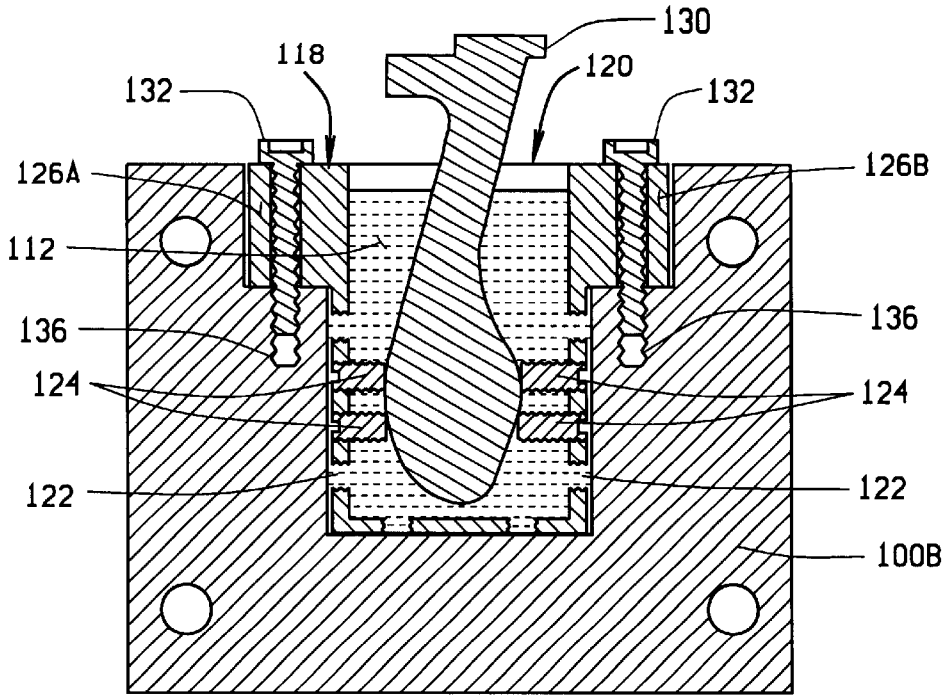
Figure 8A:
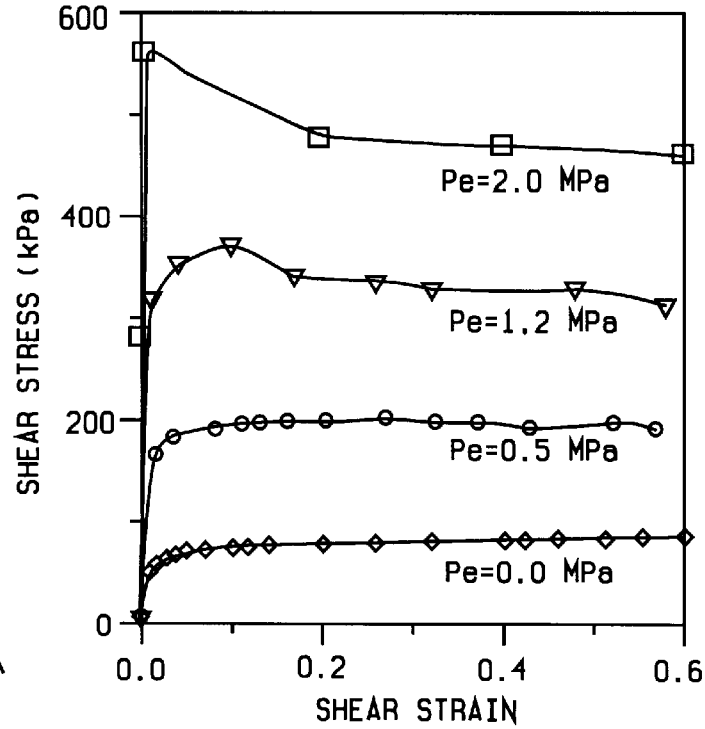
Figure 8B:
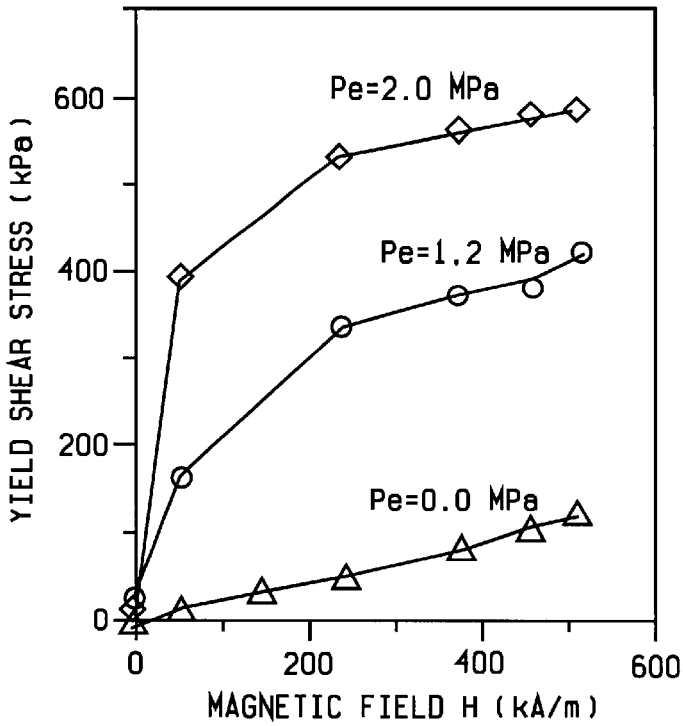
Figure 8C:
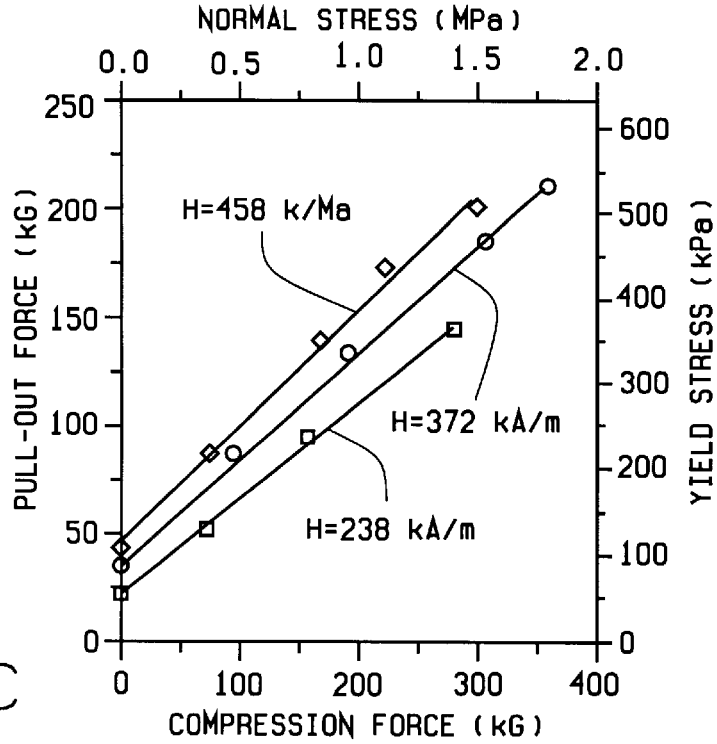
Figure 9:
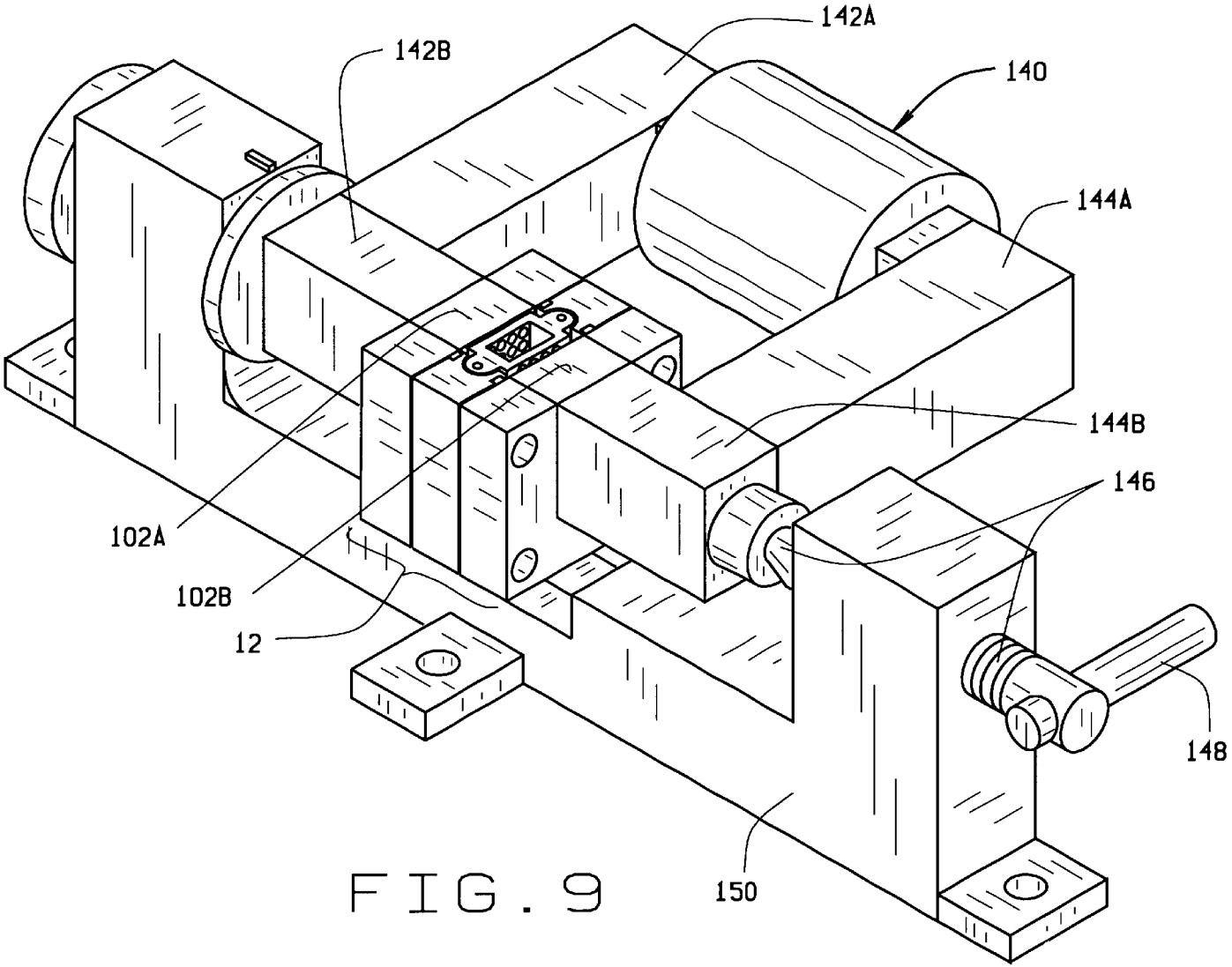
Figure 10:
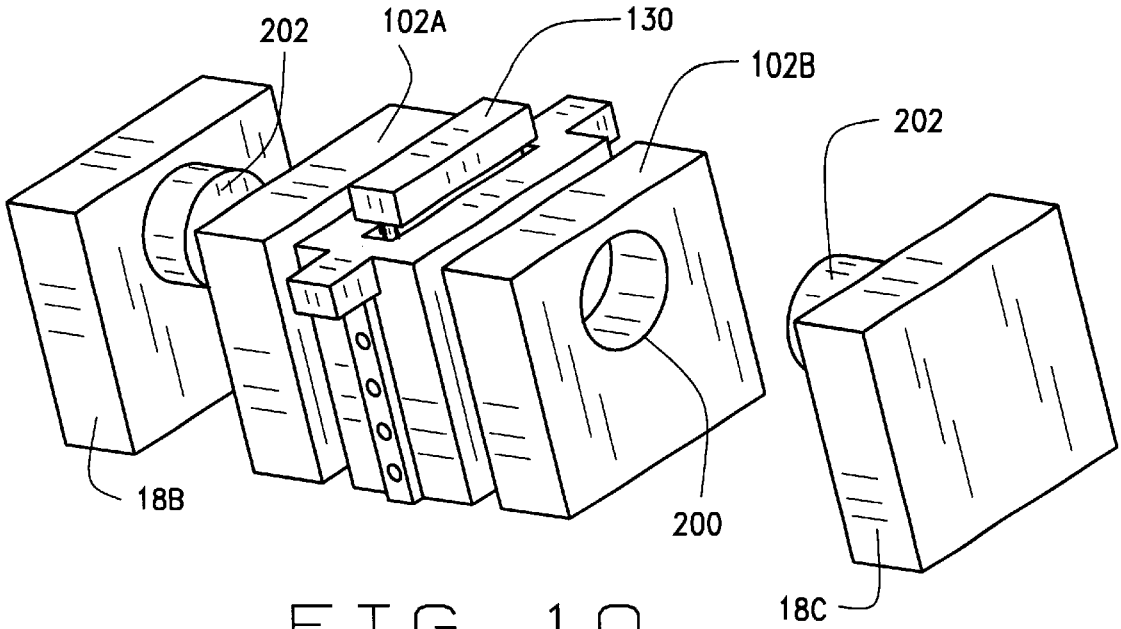
Figure 11:
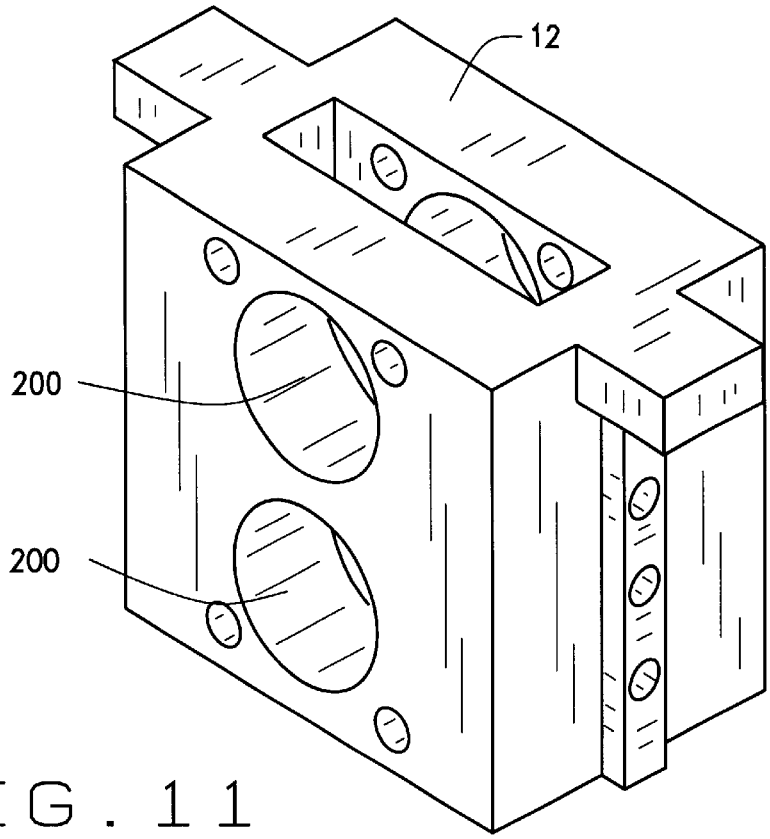

FIG. $\mathbf{6}_A$ is a sectional view of the magnetorheological liquid containing cell of FIG. 3;

FIG. $\mathbf{6}_B$ is a sectional view of the magnetorheological liquid containing cell of FIG. 3 and the workpiece holding fixture of FIG. 5, illustrating the workpiece holding fixture of FIG. 5 immersed in a magnetorheological liquid;

FIG. $\mathbf{6}_C$ is a cut-away view of the magnetorheological liquid containing cell of FIG. 3 and the workpiece holding fixture of FIG. 5, illustrating the placement of the workpiece holding fixture in FIG. 5;

FIG. 7 is a sectional view of the view of the magnetorheological liquid containing cell of FIG. 3 and the workpiece holding fixture of FIG. 5, illustrating the workpiece holding fixture of FIG. 5 with an irregularly shaped workpiece within the workpiece holding fixture, immersed in a magnetorheological liquid;

FIG. $\mathbf{8}_A$ is a graphical representation of shear stress versus shear strain for a solidified magnetorheological material at different levels of compression, illustrating increased shear stress levels for a given shear strain level in response to increased level of compression;

FIG. $\mathbf{8}_B$ is a graphical representation of yield shear stress versus magnetic field strength for a magnetorheological material at different levels of compression, illustrating an increase in yield shear stress for a given magnetic field strength in response to an increased level of compression;

FIG. $\mathbf{8}_C$ is a graphical representation of pull-out force and yield stress versus compression force and normal stress for a magnetorheological material subjected to different magnetic field strengths, illustrating an increase in pull-out force and yield stress for a given level of compression force in response to an increase in magnetic field strength; and FIG. 9 is a perspective view of an alternate embodiment of the work holding device of the present invention utilizing an electromagnet to supply a magnetic field to the magnetorheological material;

FIG. 10 is an exploded view of an alternate embodiment holding fixture including piston receiving bores for application of a compressive force; and FIG. 11 is a perspective view of an alternate embodiment cell member including piston receiving bores for application of a compressive force.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
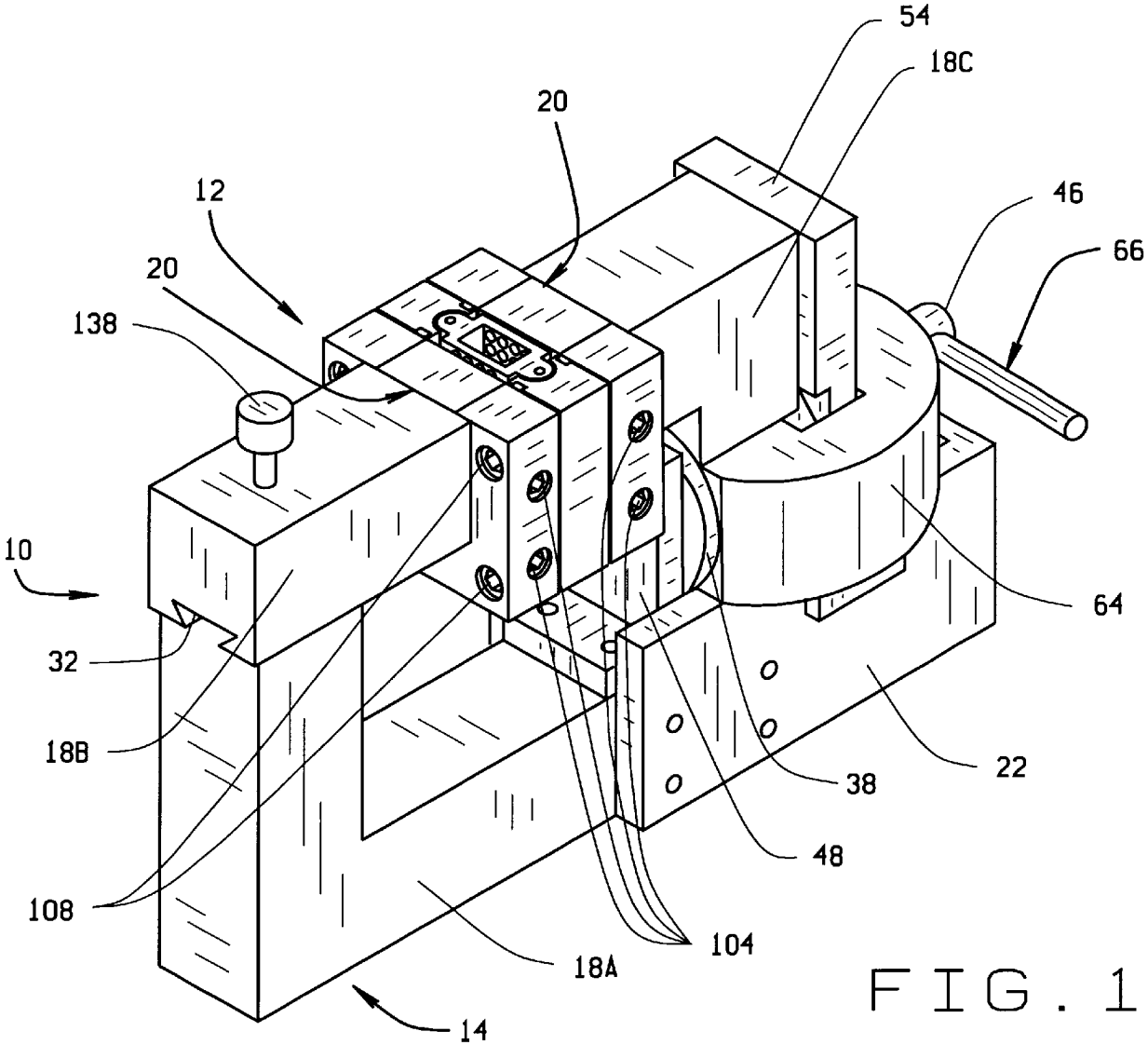
FIG. 1 is a perspective view of a first embodiment of the work holding device of the present invention utilizing a permanent magnet to supply a magnetic field to the magnetorheological material.
Figure 2:
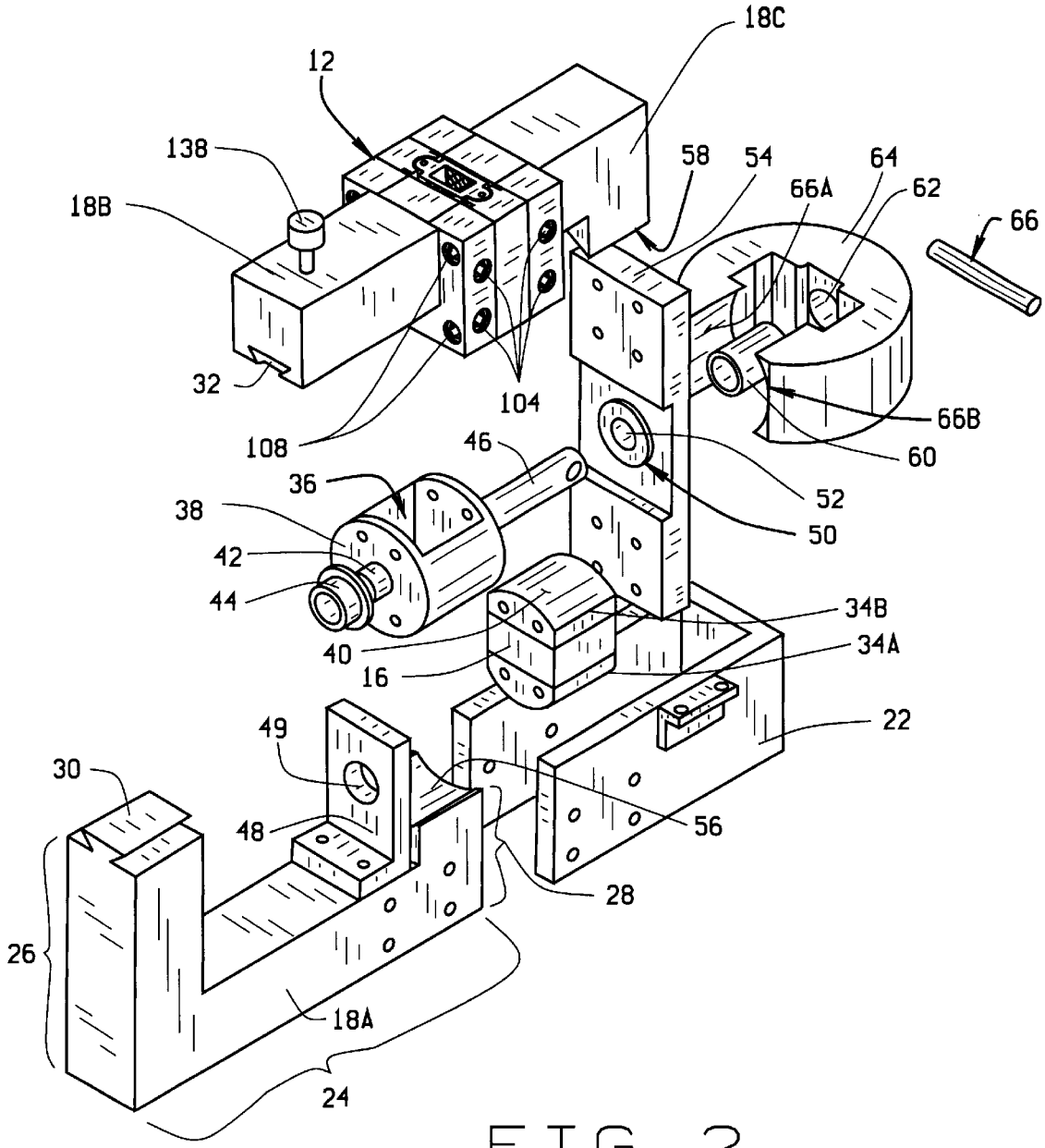
FIG. 2 is an exploded perspective view of the work holding device of FIG. 1.

Turning to FIGS. 1 and 2, a preferred embodiment of the workholding device 10 of the present invention is illustrated. The workholding device 10 includes a magnetorheological (MR) material cell 12, and a magnetic field assembly 14. The magnetic field assembly 14 comprises a permanent magnet 16, preferably composed of rare earth alloys, as a high-strength magnetic field source secured into a square shaped arrangement of magnetic arms $\mathbf{18}_A$, $\mathbf{18}_B$, and $\mathbf{18}_C$ which are composed of a soft iron or other magnetic material having a high permeability and low residual magnetization, and which define a gap region 20. The MR material cell 12 is detachably secured within the gap region 20, forming a closed loop magnetic circuit with the permanent magnet 16 and the magnetic arms $\mathbf{18}_A$, $\mathbf{18}_B$, and $\mathbf{18}_C$. A frame 22 secured to the magnetic arm $\mathbf{18}_A$ and provides a solid structure for attachment of the workholding device 10 to a workbench (not shown) or other suitable location.

As shown in FIG. 2, magnetic arm $\mathbf{18}_A$ comprises an elongated rectangular base portion 24, a first upright extension 26 at one end of the base portion 24, and a second upright extension 28 at the opposite end of the base portion 24. Both the first and second extensions 26, 28 are arrayed perpendicular to the base portion 24 in the same direction, defining a generally U-shaped member, with the first extension 26 having a greater length than the second extension 28. An upper surface of the first extension 26 includes a tongue 30 configured to engage a groove 32 on the underside of magnetic arm 18*b*, thereby permitting magnetic arm 18*b* to slide parallel to the base portion 24 of magnetic arm 18*a* while maintaining contact with the first extension 26.

As also best seen in FIG. 2, the permanent magnet 16 is preferably rectangular in shape, and enclosed on two sides by solid arch-shaped magnet shoes $\mathbf{34}_A$ and $\mathbf{34}_B$ composed of a soft iron or other good magnetic material having a high permeability and low residual magnetization. The permanent magnet 16 and the arch-shaped magnet shoes $\mathbf{34}_A$ and $\mathbf{34}_B$ are secured within a magnet receiving slot 36 passing radially through a cylindrical magnet holder 38 composed of a non-magnetic material, such that an outer surface 40 of each magnet shoe $\mathbf{34}_A$, $\mathbf{34}_B$ is flush with, and has the same curvature as, the exterior surface of the magnet holder 38. A first support shaft 42 extends axially from an anterior surface of the cylindrical magnet holder 38, and is surrounded by a bearing bushing 44. A second support shaft 46 extends axially from a posterior surface of the cylindrical magnet holder 38. A bushing frame 48 secured to the upper surface of the magnetic arm $\mathbf{18}_A$, adjacent the second extension 28 receives the first support shaft 42 and bearing bushing 44 in a receiving bore 49. The second support shaft 46 passes through a second bearing bushing 50 seated in a second receiving bore 52 in a upright connection plate 54 secured perpendicular to said frame 22 adjacent the second extension 28 of the magnetic arm $\mathbf{18}_A$. The permanent magnet 16 secured within the cylindrical magnet holder 38 is thereby positioned adjacent a cylindrically concave upper surface 56 of the second extension 28, and is free to rotate through a full revolution.

Magnetic arm $\mathbf{18}_C$ is secured to the upright connection plate 54 above the permanent magnet 16 and cylindrical magnet holder 38. Generally L-shaped magnetic arm $\mathbf{18}_C$ includes a cylindrically convex surface 58 adjacent the cylindrical magnet holder 38, such that magnet holder 38 and the permanent magnet 16 are partially enclosed between surfaces 56 and 58. Magnetic arm $\mathbf{18}_C$ extends parallel to the elongated base portion 24 of magnetic arm $\mathbf{18}_A$, towards magnetic arm 18*b*. The combined lengths of magnetic arms $\mathbf{18}_B$ and $\mathbf{18}_C$ are shorter than the length of the elongated base portion 24, thereby defining the gap region 20 into which the MR material cell 12 is secured, closing the magnetic circuit.

The second support shaft 46 passing through the second bearing bushing 50 extends axially though an elongated bushing 60 seated in an axial bore 62 of a horseshoe magnet 64 fitted around the upright connection plate 54 perpendicular to the plane defined by the magnetic arms $\mathbf{18}_A$, $\mathbf{18}_B$, and $\mathbf{18}_C$. The horseshoe magnet 64 includes two cylindrical convex surfaces $\mathbf{66}_A$ and $\mathbf{66}_B$ which lie adjacent cylindrical convex surfaces 56 and 58, thereby defining a generally cylindrical chamber within which the cylindrical magnet holder 38 and permanent magnet 16 are positioned.

The distal end of the second support shaft 46 extends beyond the exterior surface of the horseshoe magnet 64, and is fitted with a perpendicular turning lever 66. Rotation of the turning lever 66 about the longitudinal axis of the second support shaft 46 causes rotation of the cylindrical magnet holder 38 and the permanent magnet 16, thereby opening the closed magnetic circuit through magnetic arms $\mathbf{18}_A$, $\mathbf{18}_B$, $\mathbf{18}_C$, and the MR material cell 12. Horseshoe magnet 64 provides a second closed magnetic circuit when the magnetic field is not supplied to the MR material cell 12, thereby reducing energy loss in the permanent magnet 16. Rotation of the cylindrical magnet holder 38 and permanent magnet 16 by 90 degrees allows the magnetic field flowing through magnetic arms $\mathbf{18}_A$, $\mathbf{18}_B$, $\mathbf{18}_C$, and the MR material cell 12 to be selectively switched on or off. In the off position, the magnetic field flows through the horseshoe magnet 64.

Turning next to FIGS. 3 through $\mathbf{6}_C$, the magnetorheological material cell 12 is preferably constructed from three adjacent U-shaped frame sections $\mathbf{100}_A$, $\mathbf{100}_B$, and $\mathbf{100}_C$ composed of a non-magnetic material such as aluminum, brass, or stainless steel. The outermost frame sections $\mathbf{100}_A$ and $\mathbf{100}_C$ each encase a cell wall $\mathbf{102}_A$, $\mathbf{102}_B$ on three sides. The cell walls $\mathbf{102}_A$, $\mathbf{102}_B$ are composed of a magnetic material such as soft iron, cast iron, or other magnetic alloys having high permeability and low residual magnetization, and are secured to the frame sections by means of countersunk threaded bolts 104. When the MR material cell 12 is secured between magnetic arms $\mathbf{18}_B$ and $\mathbf{18}_C$, cell wall $\mathbf{102}_A$ contacts magnetic arm $\mathbf{18}_B$, and cell wall $\mathbf{102}_B$ contacts magnetic arm $\mathbf{18}_C$, allowing the magnetic field to extend into the MR material cell 12.

While shown in a square configuration in FIGS. 3 through $\mathbf{6}_C$, it will be recognized that the cell walls $\mathbf{102}_A$ and $\mathbf{102}_B$ may be configured in any manner which will increase the strength of the magnetic field extending into the MR material cell 12 by directing or focusing the magnetic flux between magnetic arms $\mathbf{18}_B$ and $\mathbf{18}_C$ into a region having an narrower cross sectional area than that of the magnetic arms $\mathbf{18}_B$ and $\mathbf{18}_C$.

In a first embodiment adapted for use with a liquid magnetorheological material, the outermost frame sections $\mathbf{100}_A$ and $\mathbf{100}_C$ includes recessed grooves 101 in the faces adjacent center frame section $\mathbf{100}_B$, into which compressible seals 106 are placed to form a liquid barrier between each of said U-shaped frame sections $\mathbf{100}_A$, $\mathbf{100}_B$, and $\mathbf{100}_C$. Countersunk threaded bolts 108 secure frame sections $\mathbf{100}_A$, $\mathbf{100}_B$, and $\mathbf{100}_C$ together, defining an open-faced volume 110 within which a magnetorheological liquid 112 is contained. The magnetorheological liquid 112 is prevented from seeping between the frame sections $\mathbf{100}_A$, $\mathbf{100}_B$, and $\mathbf{100}_C$ by the liquid barrier of compressible seals 106. The center frame section 100*b* further includes a pair of recessed regions $\mathbf{114}_A$, $\mathbf{114}_B$ on an inner surface 116 each sized to receive a portion of workpiece holding fixture 118.

The preferred embodiment of the workpiece holding fixture 118 for use with a liquid magnetorheological material is shown in FIG. 5, and is composed of either a magnetic or non-magnetic material. The holding fixture 118 is preferably a hollow rectangular container having an open end 120, and an interior volume 121, but may be of any shape such as cylindrical, triangular, or irregular, depending upon the size and shape of workpieces with which it is to be utilized. Opposite sides of the preferred holding fixture 118 each includes a plurality of threaded bores 122 which are axially aligned. Holding setscrews or threaded bolts 124 are seated within a number of the threaded bores 122, while a number of the bores 122 are left empty. The exterior surface of the workpiece holding fixture 118 includes a pair of hemicylindrical protrusions $\mathbf{126}_A$ and $\mathbf{126}_B$ configured to seat loosely within the recessed portions $\mathbf{114}_A$, $\mathbf{114}_B$ on the inner surface 116 of the center frame section $\mathbf{100}_B$.

During use, a workpiece 130 to be immobilized is placed in the open end 120 of the holding fixture 118, as seen in FIG. 7, and secured in the desired position and orientation by a plurality of workpiece holding elements such as holding setscrews or threaded bolts 124 threaded in through threaded bores 122. The holding screws or threaded bolts 124 contact the surface of the workpiece 130 with a minimum force necessary to hold the workpiece 130 in the desired position and orientation, and are preferably utilized in pairs from opposite sides of the holding fixture 118, thereby absorbing peak forces and minimizing distortion of the workpiece 130. It is preferred that the holding screws or threaded bolts 124 be composed of a soft material, such as Teflon™, to avoid damage to the surface of the workpiece 130. In any case, the hardness of the holding setscrews or threaded bolts 124 is less than the harness of the workpiece 130 to avoid workpiece damage. The number of setscrews or threaded bolts 124 utilized depends upon the size and geometry of the workpiece 130. The remaining threaded bores 122 are left empty.

It will be readily apparent to one of ordinary skill in the art that a variety of workpiece holding elements other than holding setscrews or threaded bolts 124 may be utilized to secure the workpiece 130 at the desired position and orientation. For example, shims, wedges or cams may be utilized separately or together with holding setscrews or threaded bolts 124, as well as other commonly known holding elements. Correspondingly, various thread-locking fluids or materials may be employed to secure the holding setscrews or threaded bolts 124 in position, preventing accidental unthreading thereof.

Next, as best seen in FIG. $\mathbf{6}_B$, the open-faced volume 110 in the magnetorheological material cell 12 is partially filled with the liquid magnetorheological material 112 to a level at or below the upper surface of the volume 110. It is preferred that the magnetorheological liquid utilized with the present invention is a mixture of carbonyl iron powder in silicon oil with a volume percentage of powder being 20% or more, and with the powder particles being generally spherical in shape and having a mean size of approximately 5 $\mu$m. However, any magnetorheological liquid such as is described in U.S. Pat. No. 5,549,837 to Ginder et al. for "Magnetic Fluid-Based Magnetorheological Fluids" which will alter viscosity to a solid or near solid state upon application of a magnetic field may be used. An alternative class of magnetorheological liquids is disclosed in U.S. Pat. No. 5,667,715 to Foister for "Magnetorheological Fluids" and utilizes powdered magnetizable solids of at least two different sizes dispersed in a base carrier liquid to substantially increase the yield stress of the magnetorheological liquid in the presence of a magnetic field.

Once the open-faced volume 110 is partially filled with the liquid magnetorheological material 112, the holding fixture 118 and secured workpiece 130 are immersed within the liquid magnetorheological material 112 until the protrusions $\mathbf{126}_A$, $\mathbf{126}_B$ of the holding fixture seat within the recessed regions $\mathbf{114}_A$, $\mathbf{114}_B$ on the inner surface 116 of the center frame section $\mathbf{100}_B$. The liquid magnetorheological material is free to flow through the unused threaded bores 122 and surround or immerse a portion of the workpiece 130 and holding fixture 118. Retaining bolts 132 may be passed through bores 134 in the holding fixture 118 to threaded receiving bores 136 in the center frame $\mathbf{100}_B$, thereby securing the holding fixture 118 into the magnetorheological material cell 12.

If the magnetorheological material cell 12 is not already secured into the gap region 20 between magnetic arms $\mathbf{18}_B$ and $\mathbf{18}_C$, it is secured therein such that the cell walls $\mathbf{102}_A$ and $\mathbf{102}_B$ are in contact with the respective magnetic arms.

To solidify the liquid magnetorheological material, a magnetic field is applied to the liquid magnetorheological material by closing the magnetic circuit defined by the magnetic arms $\mathbf{18}_A$, $\mathbf{18}_B$, $\mathbf{18}_C$, the MR material cell 12, and the permanent magnet 16. The magnetic circuit is closed when the permanent magnet 16 of the preferred embodiment is rotated to a first position bringing the poles of the permanent magnet 16 into alignment with magnetic arms $\mathbf{18}_A$ and $\mathbf{18}_C$, and opened when the permanent magnet 16 is rotated 90 degrees to a second position, bringing the poles of the permanent magnet 16 into alignment with the cylindrical convex surfaces $\mathbf{66}_A$ and $\mathbf{66}_B$ of horseshoe magnet 64. When in the closed position, the magnetic field significantly increases the viscosity of the liquid magnetorheological material to a solid or near solid state, applying a uniform holding force between surfaces of the workpiece 130, the holding fixture 118 immersed therein, and the MR material cell 12, immobilizing the workpiece 130 for machining or measuring operations.

The solidified magnetorheological liquid further serves to attenuate vibrations in the workpiece 130 during machining or measuring operations, while the holding fixture 118 absorbs or attenuates peak vibration forces transmitted through the workpiece 130. For measurement and some simple machining operations, solidifying the liquid magnetorheological material 112 may be all that is necessary.

However, for most machining operations, the use of the holding fixture 118 and further compression of the solidified magnetorheological liquid 112, as described further below is typically required.

Upon completion of the machining or measuring operations, the magnetic circuit is opened, by rotating the permanent magnet of the preferred embodiment to the open position, diverting the magnetic field away from the solidified magnetorheological liquid 112. The holding fixture 118 and workpiece 130 are removed by reversing the insertion operations.

In the preferred embodiment, the uniform holding force applied to the workpiece 130 immersed in the liquid magnetorheological material 112 is further increased by the application of a compressive force to the solidified magnetorheological liquid 112. Applying a force to the magnetic arm $\mathbf{18}_B$ in the direction of the MR material cell 12 and in the direction of the magnetic field causes movement of the magnetic arm $\mathbf{18}_B$ along the tongue and groove connection with magnetic arm $\mathbf{18}_A$ as the compressible seals 106 between the frames $\mathbf{100}_A$, $\mathbf{100}_B$, and $\mathbf{100}_C$ of the MR material cell 12 are compressed, decreasing the volume defined by the interior of the MR material cell 12. Compression of the seals 106 in turn applies a compressive force on the solidified magnetorheological liquid in the direction of the magnetic field, further increasing the viscosity of the magnetorheological liquid by causing the magnetic particles suspended in the magnetorheological liquid to form thick columnar structures, correspondingly increasing the uniform holding force immobilizing the workpiece 130 as is illustrated graphically in FIGS. $\mathbf{8}_A$–$\mathbf{8}_C$.

Once a desired level of compression is reached, a lockbolt 138 in magnetic arm $\mathbf{18}_B$ may be tightened, securing the magnetic arm $\mathbf{18}_B$ in the altered position to maintain the force on the solidified magnetorheological liquid, and the compressive force removed. To release the force, the lockbolt 138 is loosened and the magnetic arm $\mathbf{18}_B$ withdrawn from the altered position prior to the removal of the magnetic field from the magnetorheological liquid.

Those of ordinary skill in the art will recognize that any suitable magnetic field source and liquid magnetorheological material may be utilized in the workholding device of the present invention, provided that the magnetic field through the liquid magnetorheological material may be selectively introduced and removed.

For example, FIG. 9 illustrates an alternate embodiment of the apparatus or device of the present invention utilizing an switchable electromagnet 140 in place of the permanent magnet 16. Applying an electrical current to the electromagnet 140 results in the generation of an electromagnetic field, and the closure of the magnetic circuit defined by the magnetic arms $\mathbf{142}_A$, $\mathbf{142}_B$, $\mathbf{144}_A$, $\mathbf{144}_B$, the MR material cell 12, and the liquid magnetorheological material contained therein. In such an alternate embodiment, mechanical components associated with the rotation of the permanent magnet 16 and the second magnetic circuit defined by 16, 64 are not necessary, as removal of the electrical current supplied to the electromagnet 140 will result in removal of the electromagnetic field from the MR material cell 12.

Additionally shown in FIG. 9 is an alternative arrangement for applying a compressive force to the magnetorheological material cell 12. The tongue 30 and groove 32 interface between magnetic arms $\mathbf{18}_A$ and $\mathbf{18}_B$ of the preferred embodiment is replicated between magnetic arms $\mathbf{144}_A$ and $\mathbf{144}_B$, and is actuated by a threaded piston 146. Rotation of the threaded piston 146 by means of a handle 148 advances or withdraws the face of the magnetic arm $\mathbf{144}_B$ to and from contact with cell wall 102*a* of the magnetorheological material cell 12, while maintaining contact between magnetic arms $\mathbf{144}_A$ and $\mathbf{144}_B$, correspondingly applying or removing a compressive force on the magnetorheological material cell 12.

One of ordinary skill in the art will recognize that numerous mechanical configurations of the present invention are possible. For example, FIG. 9 illustrates the use of an alternative support base 150. Similarly, numerous configurations utilizing either permanent magnets or electromagnets to selectively apply a magnetic field to the volume of liquid magnetorheological material 112 contained within an open cell are possible, resulting in the solidification of the magnetorheological liquid about a workpiece immersed therein. Similarly, a variety of well known mechanical and hydraulically actuated configurations for applying a compressive force to the solidified magnetorheological liquid contained within the open cell are possible. For example, an external clamping force may be applied in-line with the magnetic field flowing between the cell walls $\mathbf{102}_A$, $\mathbf{102}_B$, or such external clamping force may be applied to the magnetorheological material cell 12 parallel to, but external to the magnetic field through the frame members comprising the magnetorheological material cell 12.

In an alternate embodiment to the present invention, the magnetorheological liquid 112 is replaced by a magnetorheological material having the properties of a malleable semi-solid, colloid, elastomer, or clay. Magnetorheological materials of this nature typically include a grease, wax, lard, silicone, rubber, putty, or clay carrier component into which the magnetic-responsive particles are uniformly suspended or embedded. Examples of elastomeric, rubber, or putty-like carriers for magnetorheological materials may be found in U.S. Pat. No. 3,978,398 to Molina. Similarly, examples of wax carriers for magnetorheological materials may be found in U.S. Pat. No. 4,025,448 to Sudol.

Utilizing semi-solids or high viscosity materials as carrier components in a magnetorheological material holding apparatus offers several advantages. First, the settling of the magnetic-responsive particles over time is greatly reduced or eliminated. As the magnetic-responsive particle distribution remains more uniform over time, the characteristic increase in viscosity or solidity of the magnetorheological material in response to the application of a magnetic field remains constant.

Second, the use of semi-solid, colloid, elastomer, or clayish carrier components provides a magnetorheological material which may be formed, packed, or molded around portions of a workpiece 130, and which will retain a basic shape irrespective of orientation relative to gravity. Those of ordinary skill in the art will readily appreciate that utilizing such magnetorheological materials will permit the loading of workpieces 130 into a holding device of the present invention at orientations other than vertical. For example, side-loading of the workpiece 130 and magnetorheological material into a magnetorheological material cell 12 becomes possible when using a semi-solid, colloid, elastomer or clayish magnetorheological materials. Additionally, the loss of magnetorheological material associated with the slashing or spilling of a liquid carrier magnetorheological material is reduced or eliminated.

Those of ordinary skill in the art will further recognize that when utilizing a non-liquid magnetorheological material, such as set forth above, the holding fixture 118 into which the workpiece 130 is secured for placement into the magnetorheological material cell 12 may be adapted or eliminated, depending upon the specific holding properties and characteristics of the magnetorheological material utilized.

For example, as seen in FIGS. 10 and 11, the holding fixture may incorporate one or more openings 200 in the cell 12 or cell walls $\mathbf{102}_A$ and $\mathbf{102}_B$, configured to receive matching extensions or pistons 202 from the arms $\mathbf{18}_A$ and $\mathbf{18}_B$ of the holding fixture 118 during the application of a magnetic field to the magnetorheological material or the application of a subsequent compressive force. The pistons 202 are preferably constructed with a circular or square cross-sectional area, but may be of any desired shape. The function of the pistons 202 is to apply a compressive force to the portion of the magnetorheological material between the piston 202 and the workpiece 130, thereby further conforming the magnetorheological material to the workpiece 130.

As a method, the present invention preferably incorporates the steps of (1) immersing a portion of a workpiece in a liquid magnetorheological material at a desired position and orientation, and (2) applying a magnetic field to the magnetorheological material to increase the viscosity of, or solidify, the liquid magnetorheological material, thereby applying a uniform holding force to the workpiece and immobilizing or securing it at the desired position and orientation during the application of the magnetic field. The solidified magnetorheological liquid may further serve to attenuate vibrations in the workpiece.

In a first alternative method, the workpiece may be secured in the desired position and orientation in a holding fixture with a minimum of force, and the combination of the holding fixture and a portion of the workpiece immersed in a liquid magnetorheological material prior to the application of the magnetic field. Upon the increase in viscosity or solidification of the liquid magnetorheological material in response to the application of the magnetic field, the magnetorheological liquid will apply a uniform holding force to the fixture and to the workpiece while the fixture absorbs peak vibration forces applied to the workpiece, thereby immobilizing or securing the workpiece at the desired position and orientation during the application of the magnetic field.

In a second alternative method, the workpiece may be located in the desired position and orientation in an open cell or container, either directly or by means of a holding fixture, with a minimum of force in an open cell while portions of a semi-solid, colloidal, elastomeric, or clayish magnetorheological material are placed between a surface of the workpiece 130 and the open cell 12. The nature of magnetorheological materials of this type permits the material to be sliced or cut into pieces having a desired shape or cross-section, for close-fitting between the surface of the workpiece 130 and the open cell 12. The portions of magnetorheological material are conformed to a portion of the surface of the workpiece 130 and the open cell by pre-squeezing, packing, compressing, molding, or settling, thereby uniformly surrounding the workpiece and reducing trapped air. A magnetic field is then applied to the portions of magnetorheological material, resulting in an increase in viscosity or solidification of the magnetorheological material and the exertion of a uniform holding force between the surfaces of the workpiece and the open cell, holding the workpiece at the desired position and orientation.

An additional step may be applied to the methods of the present invention to further increase the uniform holding force applied to the workpiece or to the fixture and workpiece combination by the solidified magnetorheological material by incorporating the application of a first compressive force to the magnetorheological material during or after the application of the magnetic field. It is preferred that the first compressive force act on the magnetorheological material in the general direction of the magnetic field, thereby resulting in an additional increase in the viscosity of the magnetorheological material by altering the physical arrangement of the magnetized particles suspended in the carrier.

However, it will be recognized that for some applications, the first compressive force and the magnetic field may be orientated at angles relative to each other, including perpendicularly. This is especially useful when securing larger workpieces, such as automobile engine blocks, thereby avoiding large gaps in the continuity of the magnetorheological material caused by the position and orientation of the workpiece material or voids therein.

Increasing the viscosity of the magnetorheological material results in an increase in the uniform holding force applied to the contacted portion of the workpiece, thereby further securing the workpiece at the desired position and orientation. The compressive forces may be applied to the components of the cell 12, compressing the cell as a whole, as described above, or may be applied through the use of extensions or pistons 202 extending from the arms $\mathbf{18}_A$ and $\mathbf{18}_B$ of the fixture 118, through openings 200 in the cell sidewalls $\mathbf{102}_A$ and $\mathbf{102}_B$ seen in FIGS. 10 and 11.

A second compressive force may be applied perpendicular to, or at an angle relative to, the first compressive force to achieve further increases in the viscosity or solidity of the magnetorheological material.

Alternatively, once the workpiece has been secured in the desired position and orientation by the combination of compressive forces and magnetic fields, the compressive forces and magnetic fields may be removed, and the fixture and workpiece combination, together with the previously compressed magnetorheological material conforming to the workpiece, may be removed from the device. The fixture and workpiece combination may then be transported to a second machining station, clamped therein, and a second or additional machining operation performed thereon, much the same as with low-melting alloy workpiece securing methods.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A method for immobilizing a workpiece comprising the steps of:

immersing a portion of said workpiece in a magnetorheological liquid; and increasing the viscosity of said magnetorheological liquid to apply a uniform holding force to said workpiece; and securing said workpiece in a desired position and orientation prior to immersion in said magnetorheological liquid.

2. The method for immobilizing a workpiece of claim 1 wherein the viscosity of said magnetorheological liquid is increased by application of a magnetic field to said magnetorheological liquid.

3. A method for immobilizing a workpiece in a fixture comprising the steps of:

positioning said workpiece at a desired position and orientation within an open container in said fixture;

placing a quantity of malleable magnetorheological material within said container;

conforming said quantity of malleable magnetorheological material between a portion of said workpiece and said container;

applying a magnetic field to said malleable magnetorheological material to cause said magnetorheological material to undergo an increase in solidity in response to said magnetic field and to apply a uniform holding force to said workpiece; and compressing said malleable magnetorheological material to cause said magnetorheological material to undergo a further increase in solidity, thereby in creasing said uniform holding force on said workpiece.

4. The method of claim 3 for immobilizing a workpiece wherein a portion of said malleable magnetorheological material is compressed by one or more pistons.

5. The method of claim 3 for immobilizing a workpiece wherein said malleable magnetorheological material is compressed in the same direction as said applied magnetic field.

6. The method of claim 3 for immobilizing a workpiece wherein said malleable magnetorheological material is compressed at an angle relative to the direction of said applied magnetic field.

7. The method of claim 3 for immobilizing a workpiece wherein said malleable magnetorheological material is compressed perpendicular to the direction of said applied magnetic field.

* * * * *

UNITED STATES PATENT AND TRADEMARK OFFICE

CERTIFICATE OF CORRECTION

PATENT NO. : 6,647,611 B2
DATED : November 18, 2003
INVENTOR(S) : Xuesong Zhang

It is certified that error appears in the above-identified patent and that said Letters Patent is hereby corrected as shown below:

Column 16,
Line 1, replace “in creasing” with -- increasing --

Signed and Sealed this

Twentieth Day of January, 2004

JON W. DUDAS
*Acting Director of the United States Patent and Trademark Office*